US005836809A

United States Patent [19]

Kosic

[11] Patent Number: 5,836,809

[45] Date of Patent: Nov. 17, 1998

[54] APPARATUS AND METHOD FOR CLEANING LARGE GLASS PLATES USING LINEAR ARRAYS OF CARBON DIOXIDE ($CO_2$) JET SPRAY NOZZLES

[75] Inventor: Thomas J. Kosic, Redondo Beach, Calif.

[73] Assignee: Eco-Snow Systems, Inc., Livermore, Calif.

[21] Appl. No.: 727,809

[22] Filed: Oct. 7, 1996

[51] Int. Cl.[6] ..... B24C 3/00

[52] U.S. Cl. ..... 451/89; 451/80; 451/38

[58] Field of Search ..... 451/80, 81, 87, 451/88, 89, 102, 38, 39, 40

[56] References Cited

U.S. PATENT DOCUMENTS

| | | | |
|---|---|---|---|
| 3,604,157 | 9/1971 | Fogle | 451/80 |
| 5,009,240 | 4/1991 | Levi | 451/40 |
| 5,142,830 | 9/1992 | Carpenter | 451/80 |
| 5,409,418 | 4/1995 | Krone-Schmidt et al. | 451/39 |
| 5,486,128 | 1/1996 | Tsuchiya et al. | 451/80 |
| 5,556,324 | 9/1996 | Shank, Jr. | 451/89 |
| 5,643,057 | 7/1997 | Isaacson | 451/81 |
| 5,651,723 | 7/1997 | Bjornard et al. | 451/89 |

*Primary Examiner*—Eileen P. Morgan
*Attorney, Agent, or Firm*—R. Craig Armstrong

[57] ABSTRACT

In accordance with the teachings of the present invention, an apparatus and method for cleaning large glass plates each having first and second major surfaces is provided. The apparatus (10) includes an enclosure (14) which maintains a cleaning environment in which a glass plate (42) is decontaminated. An actuated support member (40) vertically translates the glass plate (42) into the enclosure (14) where it is supported with its first (46) and second (48) major surfaces substantially perpendicular to a ground plane defined by the floor space (12) occupied by the apparatus (10). A pair of opposing arrays of jet spray nozzles (62 and 64) coupled to a pressurized supply of liquid carbon dioxide (94) is provided for simultaneously directing carbon dioxide snow particles (96) in directions of the first and second major surfaces (46 and 48) of the glass plate (42), thereby removing contamination therefrom. The carbon dioxide snow particles (96) sublime within the cleaning environment of the enclosure (14).

20 Claims, 3 Drawing Sheets

APPARATUS AND METHOD FOR CLEANING LARGE GLASS PLATES USING LINEAR ARRAYS OF CARBON DIOXIDE ($CO_2$) JET SPRAY NOZZLES

BACKGROUND OF THE INVENTION

1. Technical Field

This invention relates to glass cleaning apparatuses and methods and, more particularly, to an apparatus and method for removing contamination from large glass plates using an entirely dry cleaning process.

2. Discussion Of Related Art

The increasing demand for electronic devices incorporating flat panel displays such as, but not limited to, portable personal computers, widescreen televisions, video recorders, cellular phones, pagers, and calculators has created an increasing demand for systems and methods of cleaning large glass plates used in the manufacture of such flat panel displays. Typically, large glass plates are cleaned and decontaminated via wet phase cleaning processes involving either a solvent power spray process or a contact brush scrubbing process. These wet phase cleaning processes are commonly employed for removing both molecular films and particulate contamination such as, but not limited to, dust, skin particles, and clothing particles. Unfortunately, cleaning systems incorporating wet phase cleaning processes are expensive because they utilize liquid solvents that require expensive waste disposal procedures and/or hazardous material controls, thereby increasing the overall cost of such systems. A problem with wet phase cleaning systems is that they often leave residue such as streaks or haze on the major surfaces of a glass plate which is unacceptable or at least is undesirable in many applications where the cleaned glass plate is ultimately utilized. Additionally, wet phase cleaning systems utilizing contact brush scrubbing processes have the potential of damaging thin film devices that are commonly deposited on the major surfaces of the glass plate or at least can degrade the quality of the surfaces.

Another disadvantage with current wet phase cleaning systems is that they have a large foot print, i.e. they consume large areas of floor space. A major factor contributing to the large size of such systems is that they handle and manipulate a glass plate in a horizontal manner with the major surfaces of the glass plate parallel to the plane of the floor where the system is employed. Such large footprints are undesirable because these systems are typically located within clean-rooms ranging from class 1000 to class 1 where floor space costs may exceed $1,000.00 (dollars) per square foot. An additional disadvantage accompanying the horizontal orientation of a glass plate includes unwanted sagging due to gravitational forces and exposure of the glass plates major surfaces to recontamination from falling particles.

Another disadvantage with wet phase systems is that they require time consuming drying steps, thereby increasing cycle times and reducing throughput. Often, this involves spin drying a glass plate to force moisture off its major surfaces.

It is therefore desirable to provide a cleaning apparatus incorporating an entirely dry method of cleaning a large glass plate that removes particulate and molecular contamination from its major surfaces.

More particularly, it is desirable to provide a cleaning apparatus and method that vertically manipulates and decontaminates a large glass plate with its major surfaces substantially perpendicular to a ground plane, thereby eliminating sagging of the glass plate, minimizing recontamination from falling particles and minimizing the overall footprint of the cleaning apparatus.

It is further desirable to provide a cleaning apparatus and method that utilizes a pair of opposing linear arrays of nozzles for simultaneously directing carbon dioxide snow particles in the directions of both major surfaces of a glass plate, thereby removing contamination therefrom while minimizing any stress experienced by the glass plate.

Yet, it is also desirable to provide a cleaning apparatus and method of cleaning large glass plates that is computer controlled for optimal nozzle manipulation for a given size glass plate.

SUMMARY OF THE INVENTION

In accordance with the teachings of the present invention, an apparatus and method for cleaning a glass plate having first and second major surfaces is disclosed. An enclosure maintains a cleaning environment in which the glass plate is cleaned and decontaminated. An actuated support member vertically translates the glass plate into the enclosure with the first and second major surfaces of the glass plate substantially perpendicular to a ground plane defined by a floor upon which the apparatus is located. At least two opposing nozzles located within the enclosure are coupled to a pressurized supply of liquid carbon dioxide for simultaneously directing carbon dioxide snow particles in directions of the first and second major surfaces of the glass plate. The impact of the carbon dioxide snow particles remove contamination from the glass plate and thereafter sublime within the cleaning environment of the enclosure.

In accordance with a preferred embodiment, the apparatus for cleaning the glass plate includes a plurality of quartz lamps, located within the enclosure, for radiatively reheating the glass plate and thereby preventing formation of condensation upon the glass plate.

In accordance with another embodiment, the at least two opposing nozzles are configured as a pair of opposing linear arrays of jet spray nozzles positioned adjacent to the first and second major surfaces of the glass plate. An actuated guiding assembly concurrently guides the arrays of nozzles throughout the first and second major surfaces of the glass plate, thereby removing contamination therefrom and minimizing the forces exerted upon the glass plate.

In accordance with another embodiment, the apparatus includes a blower assembly for directing a uniform laminar flow of filtered gas over the first and second major surfaces of the glass plate. The blower assembly also recirculates the gas throughout the enclosure. A filter assembly coupled to the blower assembly filters particulates from the sublimated carbon dioxide gas for maintaining the particular class cleaning environment within the enclosure.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

The following description of the preferred embodiments is merely exemplary in nature and is in no way intended to limit the invention or its application or its uses.

The present invention is particularly concerned with providing an apparatus and method for removing contamination from large glass plates using an entirely dry cleaning process. The present invention removes both molecular films and particulate contamination from large glass plates such as, but not limited to, those used in the manufacture of flat panel displays. The present invention allows such glass plates to be cleaned at any stage during the manufacturing process including prior to or subsequent to deposition of transistor arrays or color pixels on their major surfaces. The present invention also advantageously manipulates and cleans a glass plate in a vertical manner with its major surfaces substantially perpendicular to a ground plane defined by the floor space that it occupies. Such vertical orientation has the advantage of eliminating any sagging in the glass plate during the cleaning process, minimizing recontamination from falling particulates and minimizing the overall footprint of the cleaning apparatus.

Figure 1:
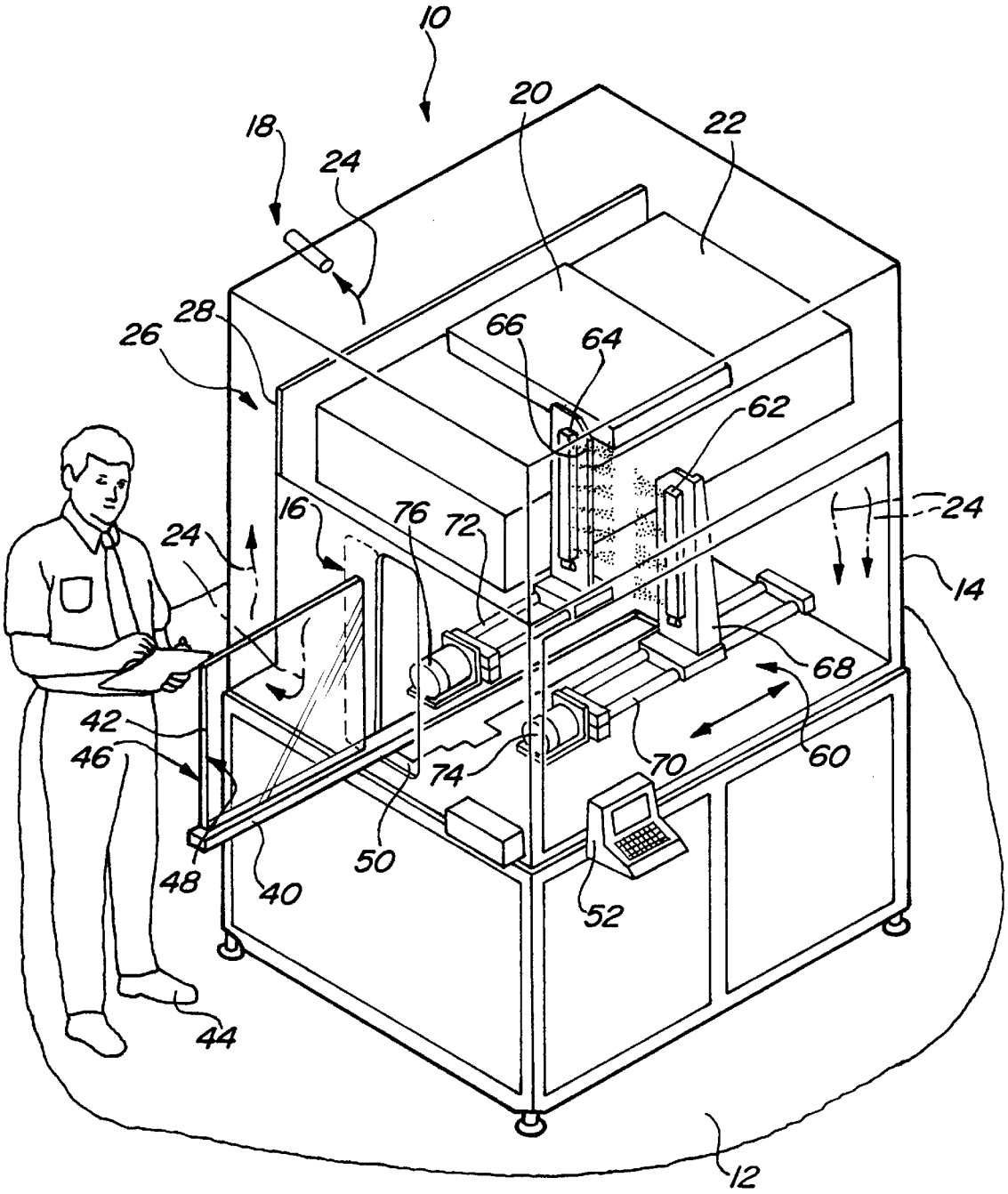
FIG. 1 is a partial cut-away perspective view of a large glass plate cleaning apparatus in accordance with the teachings of the present invention.

Referring to FIG. 1, a large glass plate cleaning apparatus 10 occupying floor space of a floor 12 is shown. The cleaning apparatus 10 includes a sealed cleaning enclosure 14 in which glass plates are cleaned and a class 1 cleaning environment is maintained to eliminate the possibility of recontamination during the cleaning process. A door assembly 16 seals the enclosure 14 and its interior volume is purged via a vent assembly 18. A dew point of less than zero degrees centigrade (0° C.), preferably minus twenty degrees centigrade (−20° C.), is maintained within the enclosure 14 to eliminate the potential for condensation during the cleaning process. A blower assembly 20 in conjunction with a filter assembly 22 maintain the cleaning environment within the enclosure 14. The blower assembly 20 circulates air, generally illustrated by lines 24, including carbon dioxide gas that has been used during the cleaning process within the enclosure 14. As will be discussed in detail below, this gas includes carbon dioxide that has sublimed during the cleaning process and has been filtered and recirculated throughout the enclosure 14. A plenum 26 formed in a backwall 28 of the enclosure 14 provides a passage for the air 24 to return the blower assembly 20 and filter assembly 22 for filtering and recirculation. Such a re-flowing design continuously re-filters the air 24 within the enclosure 14, thereby maintaining an ultra cleaning environment. The vent assembly 18 controls the pressure within the enclosure 14 by relieving excess pressure when needed. Preferably, the filter assembly 22 incorporates a HEPA-type or a ULPA-type filter for removing particles down to one tenth (0.1) of a micron in size.

An actuated support rail member 40 receives a contaminated glass plate 42, loaded by an operator 44 or other suitable means, at a loading and unloading location for cleaning and decontamination. The support member 40 is adjustable to received glass plates of varying sizes to accommodate for different cleaning applications. As illustrated, the glass plate 42 is vertically secured to the support member 40 with its major surfaces 46 and 48 substantially perpendicular to a ground plane defined by the floor 12. When actuated, the support member 40 vertically translates the glass plate 42 into the interior of the enclosure 14 through an access opening 50. Thereafter, the door assembly 16 closes and seals the opening 50 and the enclosure 14 from the outside environment. A programmable computer 52 is provided for receiving cleaning process input parameters from the operator 44 which are dependent upon the size of a glass plate being cleaned. The computer 52 may also be programmed via a suitable programming language to define the cleaning process parameters and control the apparatus 10 when cleaning standard size glass plates.

After the glass plate 42 is vertically translated via support member 40 into the cleaning environment within the enclosure 14, a jet spray nozzle assembly 60 simultaneously cleans and decontaminates the major surfaces 46 and 48 using a completely dry process, i.e. only solid and gas carbon dioxide are used. The assembly 60 includes first and second linear arrays of jet spray nozzles 62 and 64 that direct carbon dioxide ($CO_2$) snow particles in directions of the major surfaces 46 and 48 of the glass plate 42. These snow particles impact the major surfaces 46 and 48, thereby decontaminating the glass plate 42. The arrays of nozzles 62 and 64 are coupled to dual axis robotic member arms 66 and 68, respectively, that travel on track members 70 and 72. Movements of the robotic arm members 66 and 68 and therefore the arrays of nozzles 62 and 64 are controlled by actuators 74 and 76. The actuators 74 and 76 in turn are actuated in response to control signals received from the computer 52. In addition, the computer 52 controls the actuation of the support member 40.

Figure 2:
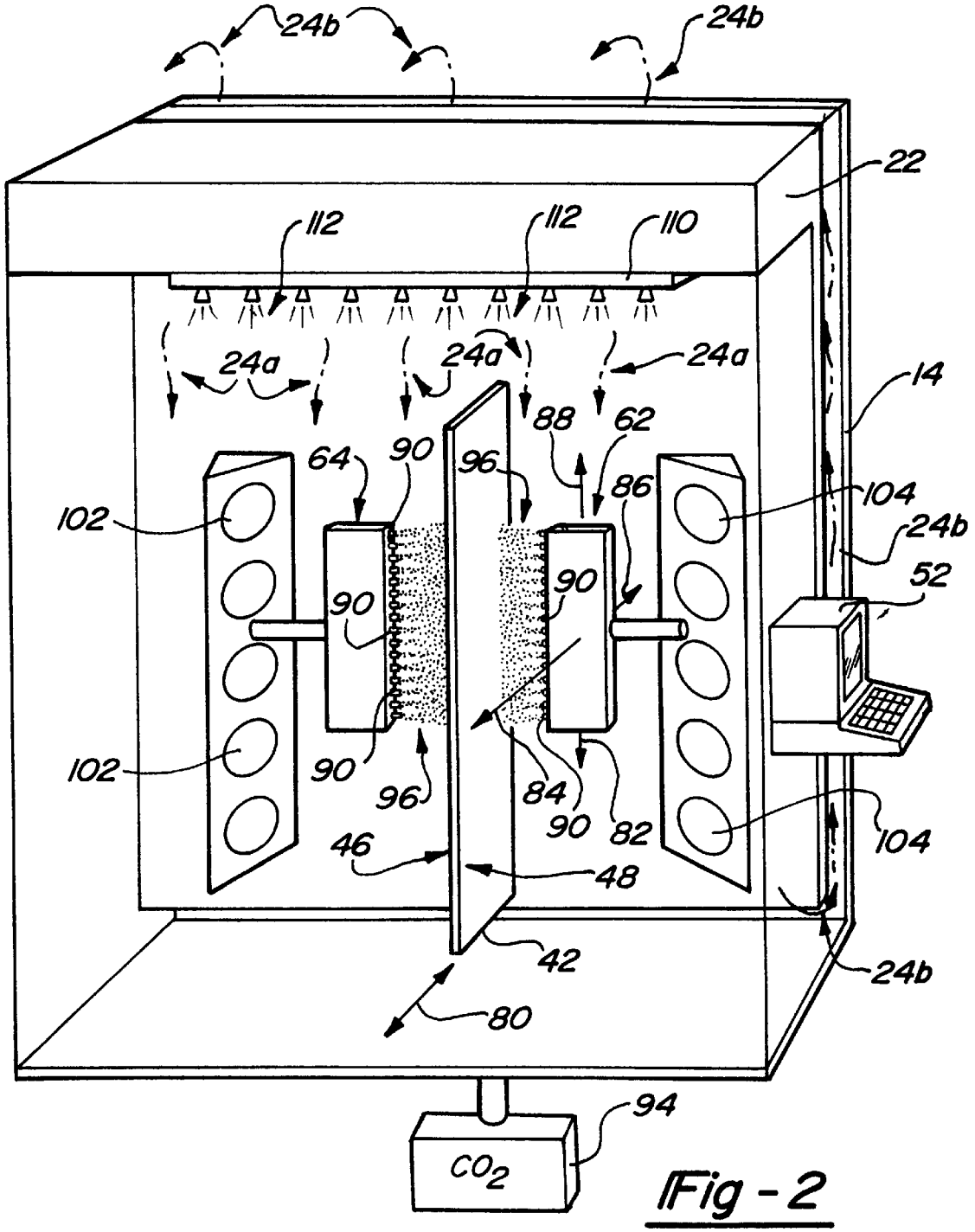
FIG. 2 is a schematic illustration of the large glass plate cleaning apparatus showing jet spray nozzles directing carbon dioxide snow particles that impact and decontaminate the major surfaces of the glass plate in accordance with the teachings of the present invention.

Turning to FIG. 2, a schematic illustration of the cleaning apparatus 10 cleaning the glass plate 42 is shown. The glass plate 42 is vertically orientated and supported by support member 40 at a cleaning location between the linear arrays of nozzles 62 and 64 such that its major surfaces 46 and 48 are substantially perpendicular to the floor 12. As represented by line 80, the support member 40 vertically translates the glass plate 42 back and forth between the loading and unloading location shown in FIG. 1 and the cleaning location. The ability of the present invention to vertically translate glass plates in and out of the enclosure 14 as well as clean the glass plates while vertically supported, minimizes the footprint of the cleaning apparatus 10 and eliminates any sagging of the glass plates due to gravitational forces. This in turn reduces the costs of cleaning such glass plates when compared to conventional wet phase cleaning devices.

As illustrated by arrows 82, 84, 86, and 88, arm members 66 and 68 guide the linear arrays of nozzles 62 and 64 in directions about two axes such that they concurrently scan and clean the entire surface areas of the major surfaces 46 and 48 of the glass plate 42. As shown, the arrays 62 and 64 each include a plurality of jet spray nozzles 90. Preferably, each of the arrays 62 and 64 include twenty (20) of the nozzles 90 and are approximately six (6) inches in length. Each of the nozzles 90 are configured and function as disclosed in commonly assigned U.S. patent applications Ser. No. 08/356,606, filed Dec. 15, 1994, and Ser. No. 08/356,607, filed Dec. 14, 1994, which are herein incorporated by reference. However, the use of other types of suitable nozzles are within the scope of the present invention.

A pressurized supply of liquid carbon dioxide 94 is coupled to each of the nozzles 90 for forming carbon dioxide snow particles 96 that are directed in directions of the major surfaces 46 and 48. The nozzles 90 are configured such that they expand the pressurized liquid carbon dioxide, thereby forming the carbon dioxide snow particles 96 that impact and clean the glass plate 42. The pressurized supply 94 preferably delivers liquid carbon dioxide to the nozzles at 850 pounds per square inch (psi) and at ambient temperature such that the snow particles 96 impact the major surface 46 and 48 with sufficient force to thoroughly clean the same. The carbon dioxide snow particles 96 have solvent properties which provide superior cleaning performance and are effective for removing submicron particles from the major surfaces 46 and 48 of the glass plate 42. As the carbon dioxide snow particles 96 warm within the cleaning environment, they sublime along with any accompanying residue into the cleaning environment of the enclosure 14 for filtration and recirculation. The use of carbon dioxide provides an entirely dry cleaning process that does not require a glass plate drying step, resulting in shorter cleaning cycle times and higher throughput when compared to conventional wet phase cleaning processes. Another advantage accompanying the use of carbon dioxide is that it is environmentally compatible which eliminates any concern for and the costs associated with waste disposal procedures and/or hazardous material controls accompanying typical wet phase cleaning processes. Also the use of carbon dioxide is relatively inexpensive when compared to the cost of commonly used liquid solvents.

In order to effectively remove contaminants from the proximity of the glass plate 42, the blower assembly 20 directs a uniform laminar flow of gas, illustrated by lines 24*a*, over the first and second major surfaces 46 and 48 of the glass plate 42. Additionally, the blower assembly 20 recirculates the gas as a return gas flow 24*b* throughout the enclosure 14 for filtering and recirculation.

Two linear arrays of high-intensity quartz lamps 102 and 104 are located within enclosure 14. As will be discussed below, the lamps 102 and 104 radiatively reheat the glass plate 42 after it has been cleaned via the carbon dioxide snow particles 96.

Inserted within the path of the uniform laminar air flow 24*a* is a throughput ion bar 110 that injects ions 112 directly into the air flow 24*a*. The ions 112 neutralize any residual static charge on the first and second 46 and 48 major surfaces of the glass plate 42.

Figure 3:
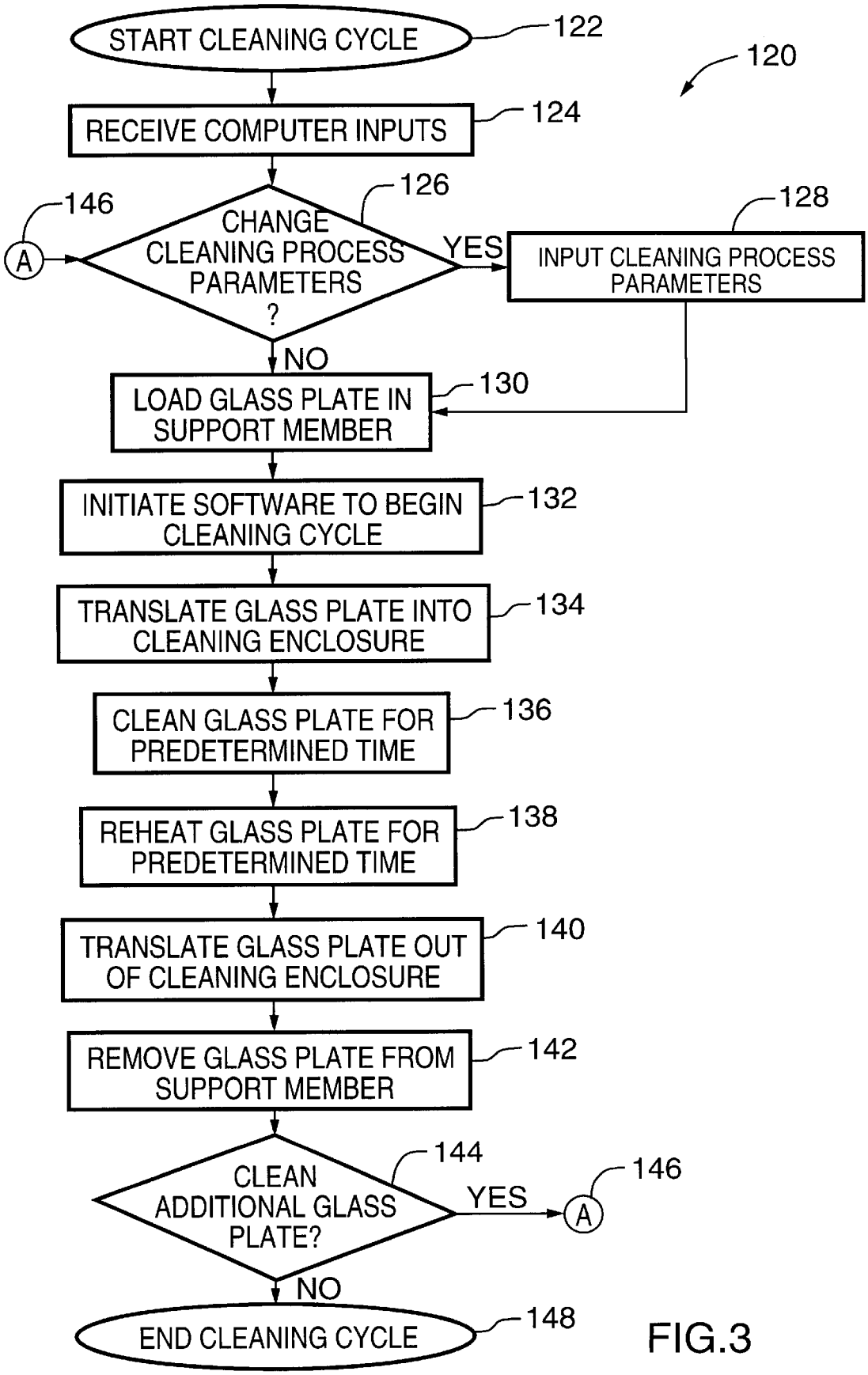
FIG. 3 is a block diagram of the overall method of cleaning a series of large glass plates in accordance with the teachings of the present invention.

Referring to FIG. 3, a block diagram 120 of the general steps involved in the method of using the present invention for cleaning and decontaminating glass plates is shown. The cleaning cycle for the cleaning apparatus 10 is started at block 122 by the operator 44. As indicated at block 124, the operator 44 accesses initial cleaning process parameters from a memory of the computer 52 for a particular standard sized glass plate being cleaned, or the operator 44 programs the computer 52 for nonstandard sized glass plates. Additionally, the computer 50 may be programmed such that a password is required to operate the apparatus 10. The computer 52 may also store records of the cleaning codes of various operators using the apparatus as well as the part numbers of the glass plates being cleaned. All this information may be archived in the memory of the computer 52 and accessed as a history file when required.

As indicated at decision block 126, a decision is made whether or not the initial cleaning process parameters stored in computer 52 are to be modified by the operator 44 for a particular glass plate being cleaned. If a determination is made that the initial parameters need to be changed, as indicated at block 128, the operator 44 inputs the modified and/or additional cleaning process parameters via the computer 50. These parameters include, but are not limited to, the nozzle scan rate and overlap for the nozzle arrays 62 and 64, the nozzle distances between the nozzle arrays 62 and 64 and the major surfaces 46 and 48 of the glass plate 42, the angle of incidence at which the carbon dioxide snow particles 96 are directed at the major surfaces 46 and 48, the heating cycle times for the lamp arrays 102 and 104, and the number of cleaning passes made by the arrays 62 and 64 across the major surfaces 46 and 48. For example, when the apparatus 10 is cleaning a glass plate having dimensions of 550 millimeters by 650 millimeters, the preferred nozzle scan rate is approximately one linear foot per second, the nozzle scan overlap is approximately one half an inch, the arrays 62 and 64 are positioned approximately two to four inches from the major surfaces 46 and 48, and the heating cycle time is approximately one minute. With such cleaning parameters, such a glass plate is cleaned in less than ten seconds and the total cleaning cycle time is under five minutes.

After the operator 44 has had the option of inputting cleaning process parameters, as indicated at block 130, the glass plate 42 is loaded upon the support member 40. The glass plate 42 is manually loaded by the operator 44 or an automated assembly may be used. Next, as indicated at block 132, the computer 52 initiates the software program stored in memory to begin the cleaning cycle according to the inputted cleaning process parameters from step 128 or according to the initial cleaning parameters from step 124. At block 134, the glass plate 42 is vertically translated in the direction of arrow 80 of FIG. 2 into the enclosure 14. Next, as indicated at block 136, the glass plate 42 is cleaned for a predetermined time which is determined a function of its size. This cleaning procedure involves simultaneously directing the carbon dioxide snow particles 96 from the nozzles 90 in the directions of the major surfaces 46 and 48 of the glass plate 42. The impact and solvent properties of the carbon dioxide snow particles 96 removes contamination from the major surfaces 46 and 48. The actuators 74 and 76 are actuated in response to signals from the computer 50 and simultaneously guide the linear arrays of nozzles 62 and 64 throughout the major surfaces 46 and 48 in directions illustrated by lines 82, 84, 86 and 88 in FIG. 2. The entire surface areas of both major surfaces 46 and 48 are simultaneously cleaned thereby avoiding placing unbalanced stresses on the glass plate 42 which could lead to fractures or damage. At the same time, the blower assembly 20 directs the laminar flow of gas 24*a* over the major surfaces 46 and 48 such that the sublimed carbon dioxide along with any contaminants are directed through the plenum 26 and recycled through the filter assembly 22. As such, the cleaning environment within the enclosure 14 is maintained at an ultra clean level. Concurrently, the throughput iron bar 110 injects the ions 112 directly into the laminar flow of gas 24*a* thereby neutralizing any residual static charge on the glass plate 42. As indicated at block 138, after the nozzle arrays 62 and 64 have completely scanned the major surfaces 46 and 48, the linear array of quartz lamps 102 and 104 are activated for radiatively reheating the glass plate 42 within the enclosure 14. This reheating step prevents condensation from forming on the glass plate 42 and any chance of recontamination due to the glass plate 42 being exposed to room temperature. Next, the glass plate 42 is vertically translated out of the cleaning enclosure 14 by the member 40 through the access opening 50. Once the glass plate 42 is fully translated out of the enclosure 14, the operator 44 or other suitable means removes the cleaned glass plate 42 from the support member 40 as indicated at block 142. Next, the computer 50 makes a determination at block 144 of whether an additional glass plate is to be cleaned. As indicated that block 146, if the computer 50 determines that another glass plate is to be cleaned, either by the operator 44 inputting commands into the computer 50 or via the initial cleaning process parameters, processing steps 126 through 144 are repeated. Once a determination is made at block 144 that no additional glass plates are to be cleaned, the cleaning cycle is ended at block 148.

As will be apparent to one skilled in the art, compared to conventional wet phase cleaning systems, the present invention has the advantage of reducing cleaning cycle times, eliminating the need for expensive liquid solvent waste removal procedures and reduces the required footprint of the cleaning apparatus due to vertical manipulation and cleaning of the clean glass plates.

The foregoing discloses and describes merely exemplary embodiments of the present invention. One skilled in the art will readily recognize from such discussion and from the accompanying drawings and claims, that various changes, modifications and variations can be made therein without departing from the spirit and scope of the present invention as defined by the following claims.

I claim:

1. An apparatus for cleaning a glass plate having first and second major surfaces, comprising:

an enclosure for maintaining a cleaning environment in which the glass plate is decontaminated;

means for vertically supporting the glass plate within the enclosure with the first and second major surfaces substantially perpendicular to a ground plane;

a pressurized supply of liquid carbon dioxide; and nozzle means, located within the enclosure and coupled to the pressurized supply of liquid carbon dioxide, for simultaneously directing carbon dioxide snow particles against the first and second major surfaces of the glass plate for removing contamination therefrom, whereby the carbon dioxide snow particles sublime within the cleaning environment.

2. The apparatus of claim 1 wherein the nozzle means includes:

at least two opposing jet spray nozzles between which the glass plate is vertically positioned and through which pressurized liquid carbon dioxide is expanded, thereby directing the carbon dioxide snow particles in the directions of the first and second major surfaces of the glass plate; and means for concurrently guiding the at least two nozzles throughout the first and second major surfaces of the glass plate, thereby removing contamination therefrom while minimizing forces exerted upon the glass plate.

3. The apparatus of claim 1 wherein the nozzle means includes:

at least two opposing linear arrays of jet spray nozzles positioned adjacent to the first and second major surfaces of the glass plate and through which pressurized liquid carbon dioxide is expanded, thereby directing the carbon dioxide snow particles in the directions of the first and second major surfaces; and means for concurrently guiding the at least two arrays of nozzles throughout the first and second major surfaces of the glass plate, thereby removing contamination therefrom while minimizing forces exerted upon the glass plate.

4. The apparatus of claim 1 further comprising:

means for radiatively reheating the glass plate within the enclosure so as to prevent formation of condensation upon the glass plate.

5. The apparatus of claim 4, wherein the means for reheating includes a plurality of quartz lamps located within the enclosure.

6. The apparatus of claim 1 further comprising:

blower means for directing a uniform laminar flow of sublimated carbon dioxide gas over the first and second major surfaces of the glass plate and for recirculating the gas throughout the enclosure means; and filter means for filtering particles from the gas within the enclosure means.

7. The apparatus of claim 6 further comprising:

means for neutralizing residual static charge on the first and second major surfaces of the glass plate, thereby minimizing recontamination of the glass plate when removed from the enclosure.

8. The apparatus of claim 7 wherein the means for neutralizing static charge includes at least one throughput ion bar for injecting ions directly into the laminar flow of gas, thereby neutralizing the residual static charge on the first and second major surfaces of the glass plate.

9. The apparatus of claim 1 wherein the means for supporting the glass plate includes:

an actuated support member for receiving the glass plate outside of the enclosure with the first and second major surfaces of the glass plate substantially perpendicular to the ground plane and for translating the glass plate through an access opening in the enclosure.

10. The apparatus of claim 1 further comprising:

controller means for receiving user input signals for controlling the translating means and the nozzle means such that the directions at which the carbon dioxide snow particles are directed is adjustable.

11. A system for cleaning a glass plate having first and second major surfaces, comprising:

an enclosure for maintaining a cleaning environment in which the glass plate is decontaminated;

an actuated support member for receiving the glass plate exterior to the enclosure and for vertically translating the glass plate into the enclosure manner with the first and second major surfaces substantially perpendicular to a ground plane;

a pressurized supply of liquid carbon dioxide;

at least two opposing jet spray nozzles located within the enclosure and between which the glass plate is positioned, the pressurized supply of liquid carbon dioxide is coupled to the at least two nozzles and through which the pressurized liquid carbon dioxide is expanded, thereby simultaneously directing carbon dioxide snow particles in directions of the first and second major surfaces of the glass plate that impact the first and second major surfaces for removing contamination therefrom;

means for concurrently guiding the at least two nozzles throughout the first and second major surfaces of the glass plate, thereby removing contamination therefrom while minimizing the forces exerted on the glass plate, whereby the carbon dioxide snow particles sublime within the cleaning environment;

blower means for directing a uniform laminar flow of subliminated carbon dioxide gas over the first and second major surfaces of the glass plate and for recirculating the gas throughout the enclosure; and filter means for filtering particles from the carbon dioxide gas within the enclosure.

12. The system of claim 11 further comprising:

means for radiatively reheating the glass plate after decontamination for preventing formation of condensation upon the glass plate.

13. The system of claim 12 further comprising:

means for neutralizing residual static charge on the first and second major surfaces of the glass plate, thereby minimizing recontamination of the glass plate when removed from the enclosure.

14. The system of claim 13 further comprising:

controller means for receiving user input signals for controlling actuation of the support member and the means for guiding the at least two nozzles such that the direction at which the carbon dioxide snow particles are directed is varied.

15. The system of claim 11 wherein at least two opposing jet spray nozzles are configured as a pair of opposing linear arrays of nozzles positioned adjacent to the first and second major surfaces of the glass plate, thereby increasing the spray coverage across the first and second major surfaces of the glass plate.

16. A method of cleaning a glass plate having first and second major surfaces, comprising the steps of:

(a) loading the glass plate upon an actuated support member in a vertical manner with the first and second major surfaces substantially perpendicular to a ground plane;

(b) translating the glass plate into an enclosure in which a cleaning environment is maintained; and (c) simultaneously directing carbon dioxide snow particles against the first and second major surfaces of the glass plate, thereby removing contamination therefrom, whereby the carbon dioxide snow particles sublime within the cleaning environment.

17. The method of claim 16 further comprising the step of:

(d) after step (c), radiatively reheating the glass plate within the enclosure for preventing formation of condensation upon the glass plate.

18. The method of claim 16 further comprising the steps of:

(d) directing a uniform laminar flow of gas over the first and second major surfaces of the glass plate and which circulates the gas throughout the enclosure; and (e) filtering particles from the subliminated carbon dioxide gas within the enclosure.

19. The method of claim 18 further comprising the step of:

(f) injecting ions within the uniform laminar flow of gas for neutralizing residual static charge on the first and second major surfaces of the glass plate and thereby minimizing recontamination of the glass plate when removed from the enclosure means.

20. The method of claim 16 further comprising the steps of:

(d) translating the glass plate out of the enclosure;

(e) removing the glass plate from the support member;

(f) determining if an additional glass plate is to be cleaned; and (g) repeating steps (a) through (f), if it is determined that an additional glass plate is to be cleaned.

* * * * *